US011084634B2

(12) United States Patent
Yu

(10) Patent No.: US 11,084,634 B2
(45) Date of Patent: Aug. 10, 2021

(54) MULTIFUNCTIONAL DISPENSING WATER BOTTLE

(71) Applicant: Chun-Ming Yu, Taoyuan (TW)

(72) Inventor: Chun-Ming Yu, Taoyuan (TW)

( * ) Notice: Subject to any disclaimer, the term of this patent is extended or adjusted under 35 U.S.C. 154(b) by 164 days.

(21) Appl. No.: 16/437,839

(22) Filed: Jun. 11, 2019

(65) Prior Publication Data

US 2020/0317409 A1 Oct. 8, 2020

(30) Foreign Application Priority Data

Apr. 8, 2019 (TW) ..... 108204212

(51) Int. Cl.
*B65D 47/06* (2006.01)
*B65D 47/08* (2006.01)

(52) U.S. Cl.
CPC ..... *B65D 47/065* (2013.01); *B65D 47/0885* (2013.01); *B65D 2543/00046* (2013.01); *B65D 2543/00537* (2013.01); *B65D 2543/00592* (2013.01)

(58) Field of Classification Search
CPC ..... B65D 47/065; B65D 47/0885; B65D 2543/00592; B65D 2543/00537; B65D 2543/00046; B65D 2231/022; B65D 77/283; B65D 47/06; B65D 47/063; B65D 47/066; B65D 47/08; B65D 81/3865; B65D 51/18; B65D 51/247; B65D 2251/0003; A47G 19/22; A47G 19/2205; A47G 21/186
See application file for complete search history.

(56) References Cited

U.S. PATENT DOCUMENTS 5,392,968 A * 2/1995 Dark ..... B65D 47/066 222/528
6,116,458 A * 9/2000 Dark ..... A47G 19/2266 220/708
7,059,490 B2 * 6/2006 Son ..... B65D 47/065 220/254.3
8,469,226 B2 * 6/2013 Davies ..... B65D 51/242 220/707
2010/0181329 A1 * 7/2010 Davies ..... B65D 47/2031 220/707
2012/0312832 A1 * 12/2012 Lane ..... B65D 51/242 220/833
2013/0048637 A1 * 2/2013 Brandenburger .. B65D 41/0442 220/212
2015/0173539 A1 * 6/2015 Mason ..... B65D 47/063 220/707

* cited by examiner

*Primary Examiner* — Kareen K Thomas
(74) *Attorney, Agent, or Firm* — Muncy, Geissler, Olds & Lowe, P.C.

(57) ABSTRACT

A multifunctional dispensing water bottle, which provides a versatile water bottle for sucking or drinking with the mouth and dispensing contained drinking liquid. A fill end closure is joined to a bottle main body and is provided with a dispensing cavity, a bottom portion of which affords passage to a dispense opening. A sucking device can movable flip open and close on another side of the dispensing cavity, a penetrating tube affords passage to a sucking passage, and the dispensing cavity is provided with a mouth opening that connects to the dispense opening. Accordingly, the above-described structure provides a water bottle for use in sucking or drinking using the mouth, or dispensing contained drinking liquid.

12 Claims, 7 Drawing Sheets

MULTIFUNCTIONAL DISPENSING WATER BOTTLE

BACKGROUND OF THE INVENTION

(a) Field of the Invention

The present invention relates to a multifunctional dispensing water bottle, which provides a versatile water bottle for sucking or drinking with the mouth and dispensing contained drinking liquid, and more particularly a multifunctional designed water bottle that primarily comprises a fill end closure provided with a dispensing cavity, which paired with a mouth opening provides a drinking method using the mouth, or can also be used for dispensing contained drinking liquid. Moreover, after opening an integral assembled sucking device, the water bottle can also be used for drinking the contained liquid by sucking.

(b) Description of the Prior Art

Due to the increasingly active promotion of environmental protection and safety in use concepts, many people participate in different present-day outdoor activities, such as leisure activities or sports, and in order to replenish the body's water content, normally the majority of people prepare their own drinking liquid for convenient drinking outdoors. Hence, related containers, such as thermos flasks or cool water bottles, are respectively configured with a diverse variety of functional designs appropriate to sports use or leisure use. Examples of designs used in different water bottles include drinking by sucking while exercising on a bicycle, or gracefully dispensing the contained liquid for drinking from a cup during leisure activities, or facilitating quick drinking with the mouth. Because of the different types of water bottles appropriate for various activities, the water bottles are separately provided with independent structural functions. Hence, in order to accommodate various types of activities, the user must carry several water bottles equipped with different drinking functions.

SUMMARY OF THE INVENTION

The primary object of the present invention is to provide a multifunctional dispensing water bottle that is a versatile water bottle for sucking, drinking with the mouth, and dispensing contained drinking liquid. The upper portion of a bottle main body is combined with a fill end closure using a direct or indirect method, wherein the upper portion of the fill end closure is provided with a long-mouth shaped dispensing cavity. The bottom portion of the dispensing cavity affords passage to a dispense opening, and a sucking device is able to movable flip open from or be stored away on another side of the dispensing cavity. A penetrating tube that penetrates the interior of the bottle main body provides a passage to suck contained drinking liquid. In addition, the dispensing cavity is provided with a mouth opening that connects to the dispense opening. Using the above-described structure enables sucking or drinking with the mouth, or dispensing contained drinking liquid.

Another object of the present invention lies in two sides of the longitudinal middle of a fill cavity is transversely configured with a movable pivot portion, which is used to connect with a base portion of the sucking device. A sucking mouth piece of the sucking device is able to flip open and be stored away in a receiving cavity of the fill cavity.

A third objective of the present invention lies in providing the sucking mouth piece with cocking wings, which enable a user's fingers to effect a cocking operation thereon and maintain hygiene of the sucking mouth piece.

A fourth objective of the present invention lies in connecting the fill end closure to the bottle main body through a connecting ring, wherein one side of the connecting ring is assembled with a flip cover. A flipping over action is used as the covering operation of the flip cover, and covering with the flip cover enables forming a thermal insulated space between the fill end closure and the flip cover.

A fifth objective of the present invention lies in providing the inner surface of the flip cover with a sealing member positionally corresponding to the dispensing cavity. The dispensing cavity is sealed after covering with the outer surface of the sealing member.

A sixth objective of the present invention lies in providing a bottle main body with a structure comprising an inner cylinder separated from an outer cylinder, with a thermal insulated space formed therebetween, wherein the upper end of the inner cylinder connects with an upper end opening to achieve heat preservation effectiveness.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
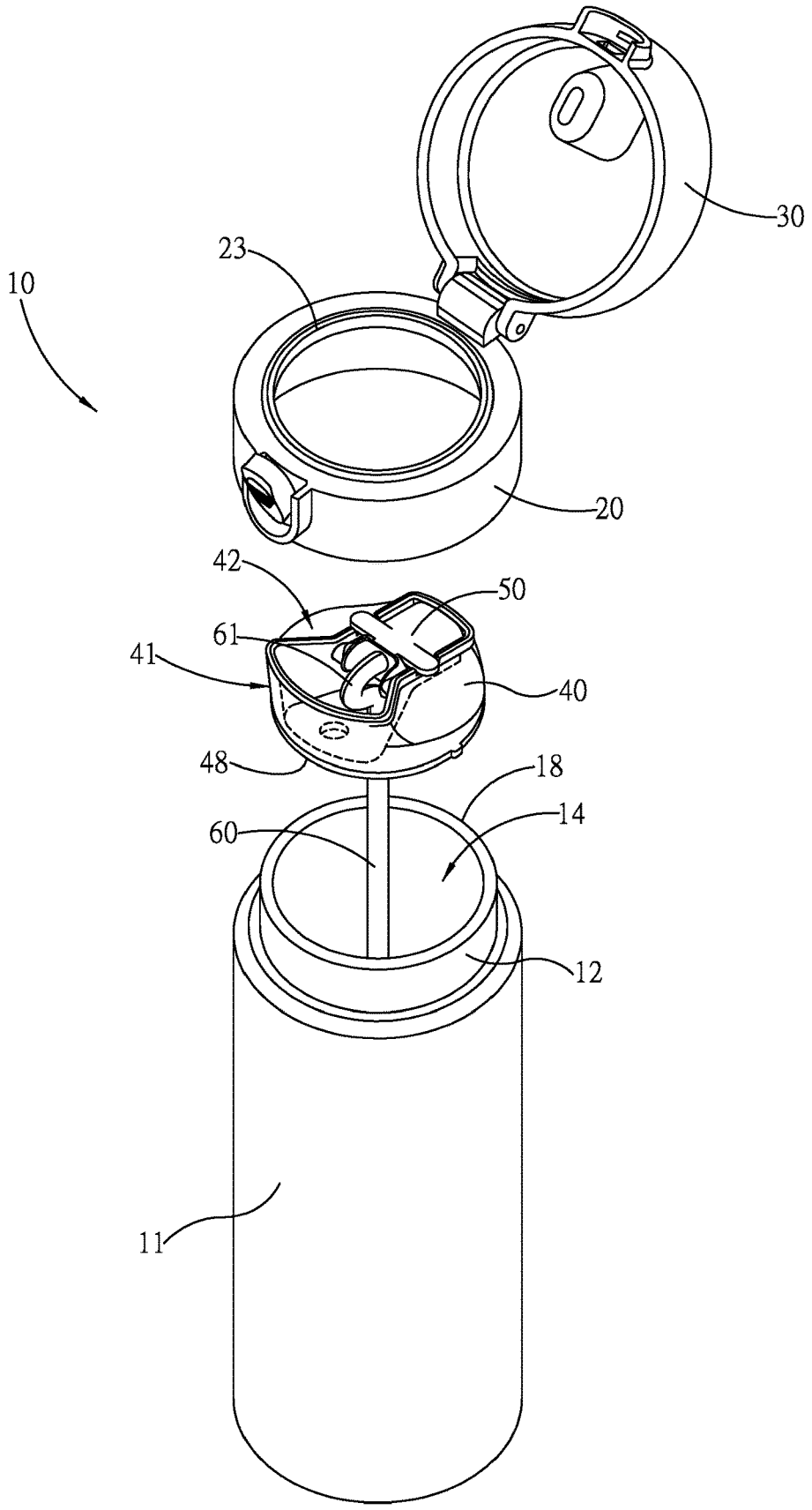
FIG. 1 is a schematic relationship view of assembly components of a water bottle structure of the present invention.

Regarding the composite structure and operating function of a water bottle of the present invention, please refer to the description of the figures as follows:

Referring first to FIG. 1, which shows a water bottle structure 10 of the present invention configured with a bottle main body 11, the interior of which is provided with a containment space 14 for carrying a drinking liquid. The containment space 14 is upwardly connected to an upper end opening 18, and after assembling a lower plate 48 configured on a fill end closure 40 to the water bottle structure 10, a water tight assembly with the upper end opening 18 is created. The upper side of the fill end closure 40 uses an upward enclosure method to enclose and form a fill cavity 42 by means of a wall surround 41. The inner surface of a flip cover 30 is able to cover and seal the space of the fill end closure 40, wherein the flip cover 30 is movable joined to a connecting ring 20. The lower end of the connecting ring 20 joins to a connecting end 12 configured at the upper end of the bottle main body 11, wherein the joining method can be either a movable mount or twist lock method that only requires the hands to accomplish and which facilitates assembly and disassembly for cleaning. An overlap collar 23 configured at the breadth center of the connecting ring 20 is bush assembled to the lower plate 48 of the fill end closure 40 and connectively locks with the upper end opening 18 of the bottle main body 11 to achieve a water tight seal. A sucking device 50 pops up/down at a position in the fill cavity 42, whereby the sucking device 50 guides a penetrating tube 60 into the interior of the containment space 14 through a flexible section 61, thus enabling the lower end of the penetrating tube 60 to guide drinking liquid from the containment space 14 into the user's mouth.

Figure 2:
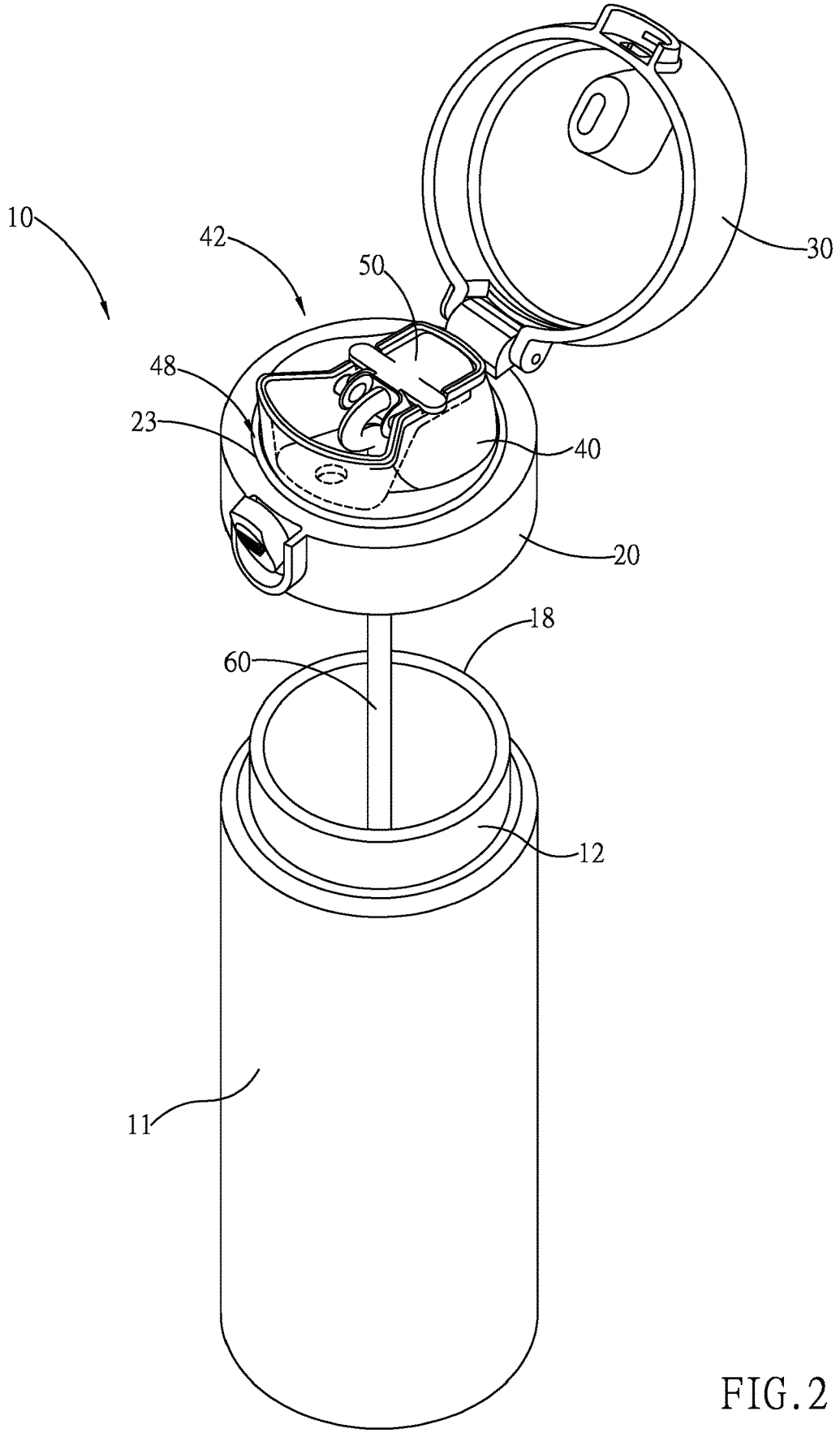
FIG. 2 is a schematic relationship view of assembly components of a connecting ring and a fill end closure of the present invention.

Referring to FIG. 2, the overlap collar 23 of the connecting ring 20 configured on the water bottle structure 10 is assembled to the lower plate 48 of the fill end closure 40. The lower end of the connecting ring 20 is assembled to the connecting end 12 of the bottle main body 11 and forms a water tight assembly with the upper end opening 18. After disengaging the connecting ring 20, the fill end closure 40 is thereupon connectively disengaged from the bottle main body 11. The connecting ring 20 is integrally movable connected to the flip cover 30, which thus concurrently accompanies the connecting ring 20 when assembling and disassembling from the bottle main body 11. The sucking device 50 is connectively assembled along with the penetrating tube 60 inside the fill cavity 42, and is similarly concurrently affected when assembling and disassembling the connecting ring 20. Flipping open the flip cover 30 enables connecting to the space inside the bottle main body 11.

Figure 3:
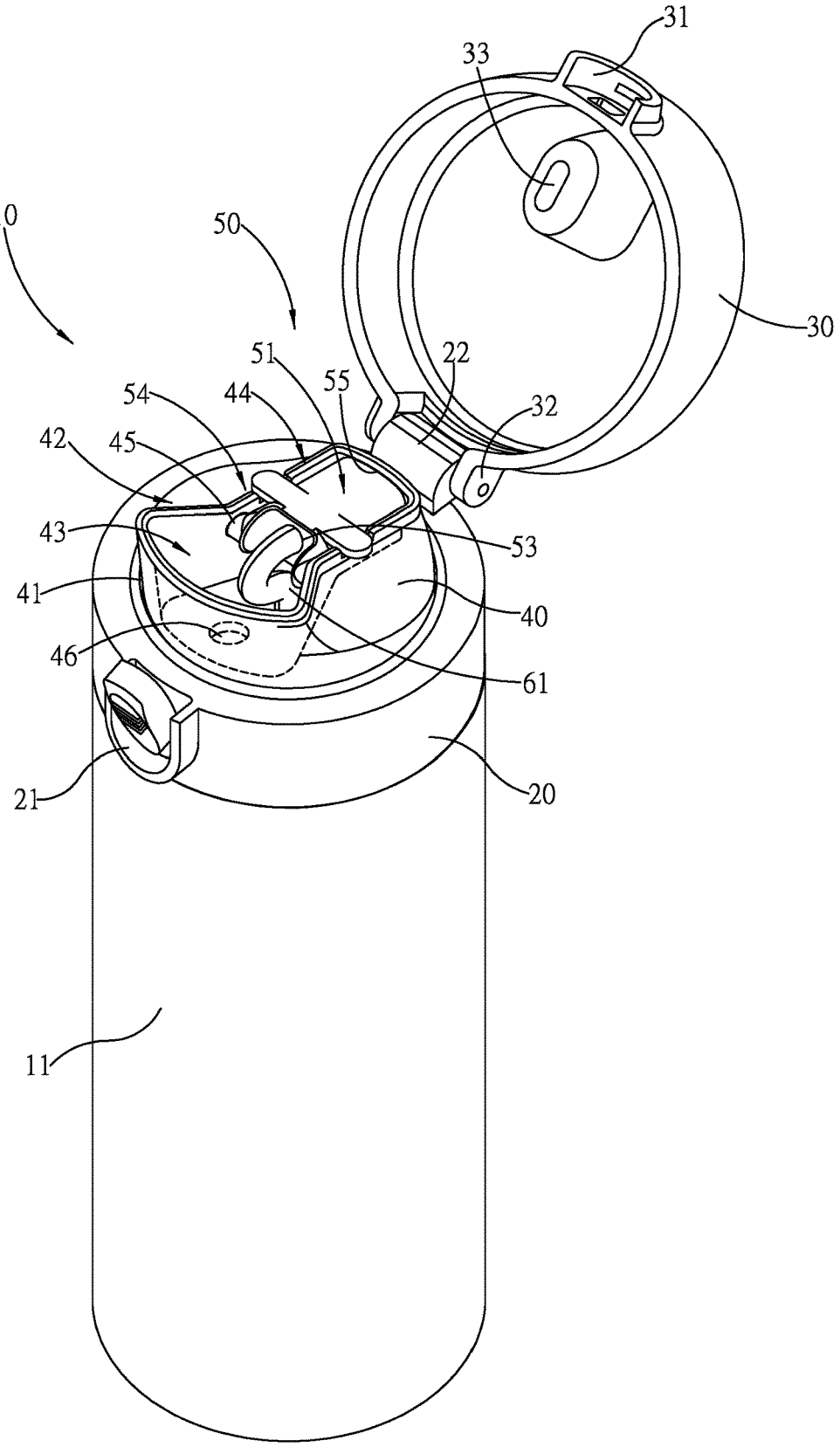
FIG. 3 is an external view of the assembled components of the water bottle structure of the present invention.

Referring to FIG. 3, the upper end of the bottle main body 11 of the water bottle structure 10 is coaxially assembled to the fill end closure 40 through the connecting ring 20, wherein one side of the connecting ring 20 is configured with a connecting portion 22, which enables connecting to a connecting piece 32 configured at a corresponding tangent position on the flip cover 30. The interior of the flip cover 30 is configured with a sealing member 33 opposite the swinging planimetric position of the connecting portion 22. In addition, the flip cover 30 is configured with a clasp portion 31 at an external tangent position corresponding to a snap fastener 21 configured on the connecting ring 20, whereby the clasp portion 31 and the snap fastener 21 form a snap fastening relationship. The interspace between the inner surface of the flip cover 30 and the fill end closure 40 when covered therewith forms an airtight or thermal insulated space.

The wall surround 41 annular enclosing the fill end closure 40 forms the fill cavity 42 and also forms a dispensing cavity 43 that extends frontward. A receiving cavity 44 is formed through the centre position at a partitioned rear end of the fill end closure 40. A bottom portion of the dispensing cavity 43 is provided with a dispense opening 46, and after assembly, the dispense opening 46 provides access to the inner space of the bottle main body 11. Two sides of the centre position of the fill end closure 40 is transversely configured with a movable pivot portion 45 longitudinal to the fill cavity 42, wherein the movable pivot portion 45 enables connecting a base portion 54 of the sucking device 50 thereto. The sucking device 50 affords passage to contained drinking liquid through a hollow sucking mouth piece 51, the outer end of which connects to a sucking outlet 55. The sucking outlet 55 reverse connects to a guide interface 53 positioned in the direction of the base portion 54. The guide interface 53 connects to the flexible section 61, which passes through the bottom portion of the fill cavity 42 to penetrate the inner space of the bottle main body 11. The stored away state of the sucking device 50 is achieved by folding back the sucking mouth piece 51 toward the receiving cavity 44 using the movable pivot portion 45 as a pivot function, after which the sucking outlet 55 press connects with the corresponding inner surface of the receiving cavity 44, wherein the pressure of the press connection derives from the mechanical force when covering with the flip cover 30, and uses the sucking outlet 55 to press connect with the corresponding surface of the receiving cavity 44 to form a contact surface fit, which causes drinking liquid to form a water film on the interfacial surface fit, preventing dispensing a large quantity of drinking liquid.

Prior to covering with the flip cover 30, the sucking mouth piece 51 is first inserted in the receiving cavity 44, and after covering with the sealing member 33 configured on the inner surface of the flip cover 30, the outer surface of the sealing member 33 press connects and seals the dispense opening 46 provided in the bottom portion of the dispensing cavity 43.

Figure 4:
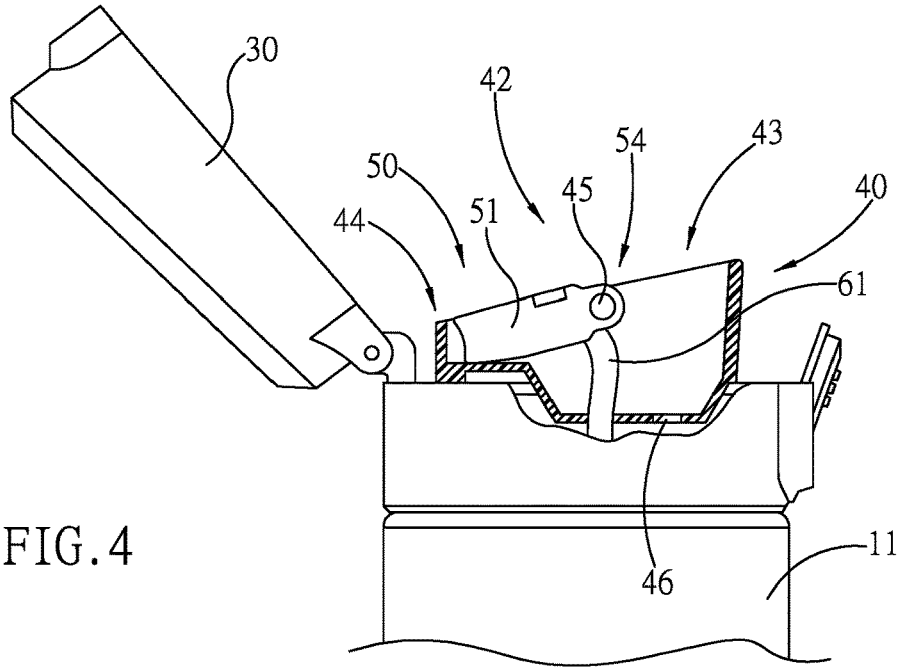
FIG. 4 is a schematic view depicting the state before drinking with the mouth or dispensing the contained beverage according to the present invention.

Referring to FIG. 4, the sucking mouth piece 51 of the sucking device 50 pivots on the movable pivot portion 45 and folds back toward the receiving cavity 44 of the fill cavity 42 to lodge therein, whereupon the flexible section 61 connected to one end of the sucking mouth piece 51 forms a sharp cornered curved shape. Thereupon enabling the dispense opening 46 to afford passage between the inner space of the bottle main body 11 and the dispensing cavity 43.

Figure 5:
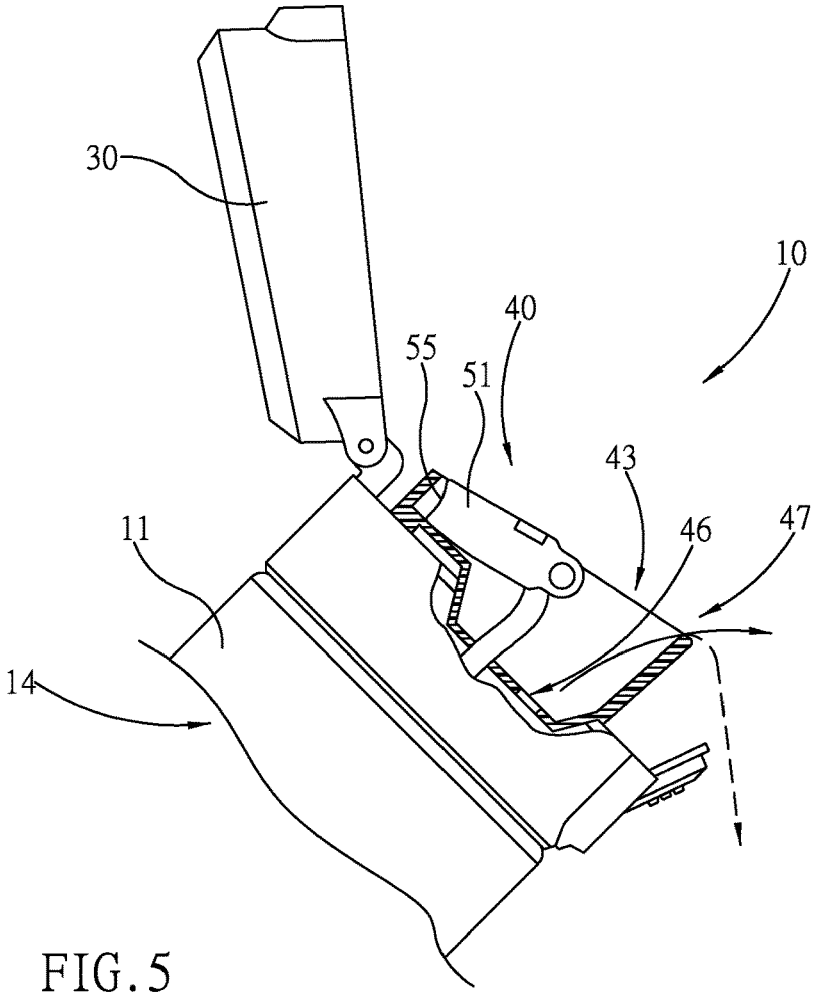
FIG. 5 is a schematic view depicting the state for drinking with the mouth or dispensing the contained beverage according to the present invention.

Referring to FIG. 5, which shows the water bottle structure 10 with the above-described flip cover 30 opened up and the sucking mouth piece 51 in a stored away state, wherein the dispense opening 46 of the dispensing cavity 43 affords passage to a mouth opening 47. When the bottle main body 11 is inclined, drinking liquid in the interior of the containment space 14 can be dispensed out from the mouth opening 47 of the dispense opening 46, whereby a user is able to drink the contained drinking liquid from the mouth opening 47 using their lips, or when dispensing drinking liquid contained inside the containment space 14, the edge parameters of the mouth opening 47 can be used to allow the drinking liquid flowing out from the dispense opening 46 to dispense downwards from the lip of the mouth opening 47. Placing the bottle main body 11 in a vertical position after finishing dispensing the drinking liquid enables the edge of the mouth opening 47 to realize the function that cuts off water similar to that of a kettle spout. When in an open state, the flip cover 30 releases the pressing force on the sucking mouth piece 51, thereby disengaging the pressure connection relationship between the sucking outlet 55 and the receiving cavity 44 (as shown in FIG. 3), with the elastic restoring force of the flexible section 61 further causing a space to form between the sucking outlet 55 and the receiving cavity 44 that enables atmospheric pressure to enter the interior of the bottle main body 11. Accordingly, when the dispense opening 46 is dispensing drinking liquid, atmospheric pressure is channeled into the interior of the bottle main body 11 through the sucking mouth piece 51.

Figure 6:
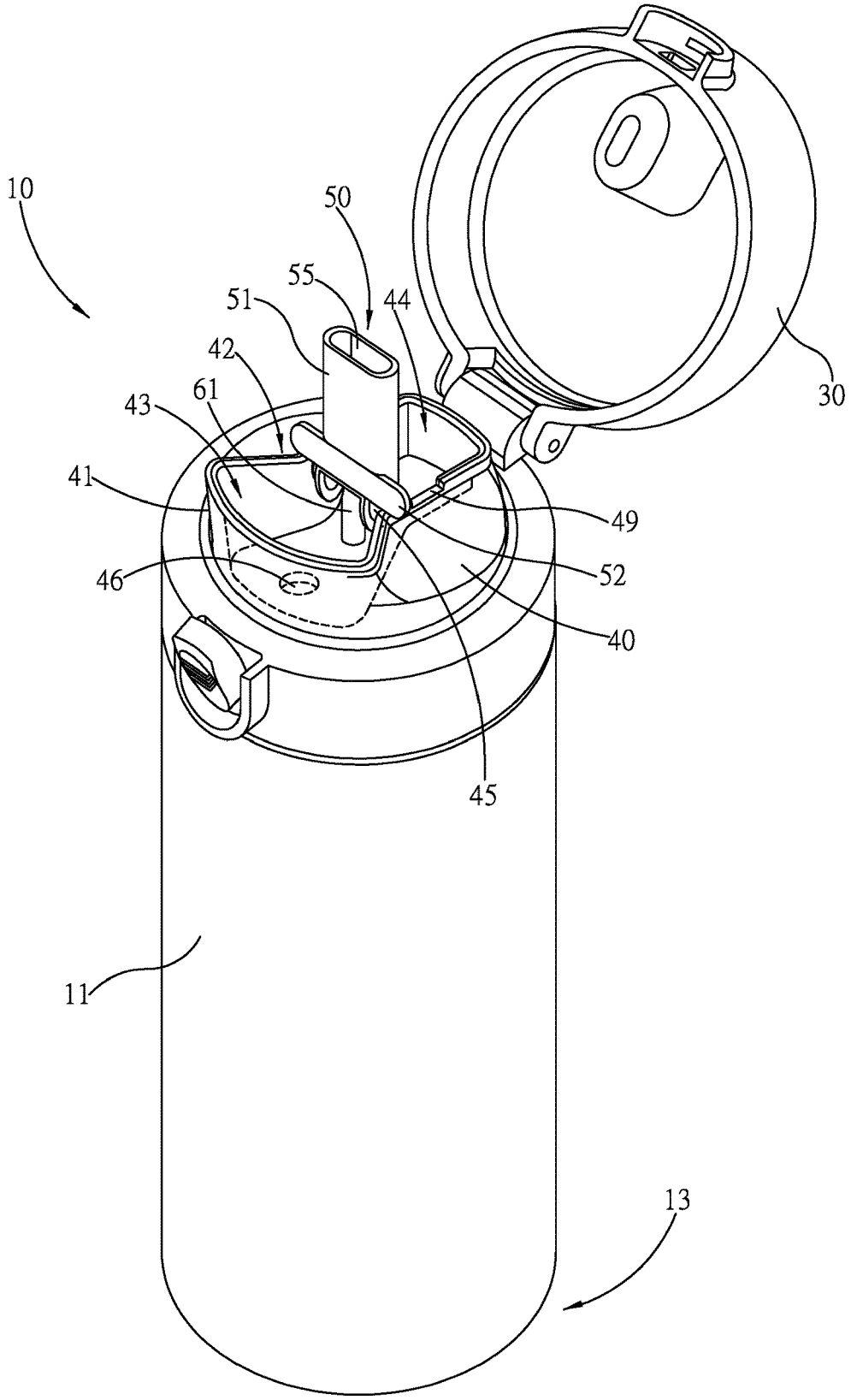
FIG. 6 is a schematic view depicting the state before using a sucking device according to the present invention.

Referring to FIG. 6, when a user wants to use a sucking method to drink the liquid inside the bottle main body 11, the flip cover 30 is first opened, and using the movable pivot portion 45 as a pivot, the user uses their fingers to cock cocking wings 52, which connectively drive the sucking mouth piece 51 to stand up and free up the sucking outlet 55, whereupon the sucking mouth piece 51 separates from the receiving cavity 44 of the fill cavity 42 enabling the flexible section 61 to afford passage to the interior of the bottle main body 11, at which time the sucking mouth piece 51 is displaced to an upright position toward the space of the dispensing cavity 43. The sucking outlet 55 affords passage to the flexible section 61 that further penetrates the interior of the bottle main body 11. When the user sucks on the sucking mouth piece 51 with an appropriate force to suck out the drinking liquid inside the bottle main body 11, then atmospheric pressure enters the interior thereof through the dispense opening 46 to facilitate drinking the liquid through the sucking outlet 55.

The cocking wings 52 configured on the sucking mouth piece 51 are exposed on the outer side of the wall surround 41 in the marginal external space thereof, and the upper edge of the wall surround 41 is indentedly provided with clasping grooves 49 corresponding to the ends of the cocking wings 52 when in a retained position to enable the cocking wings 52 to enter therein. Furthermore, the cocking wings 52 protrude out to the fill end closure 40 to facilitate a user's fingers to perform a cocking operation thereon, thus maintaining cleanliness of the sucking mouth piece 51. When standing upright, the entire water bottle structure 10 stands on a bottle base 13 configured at the bottom portion of the bottle main body 11.

Figure 7:
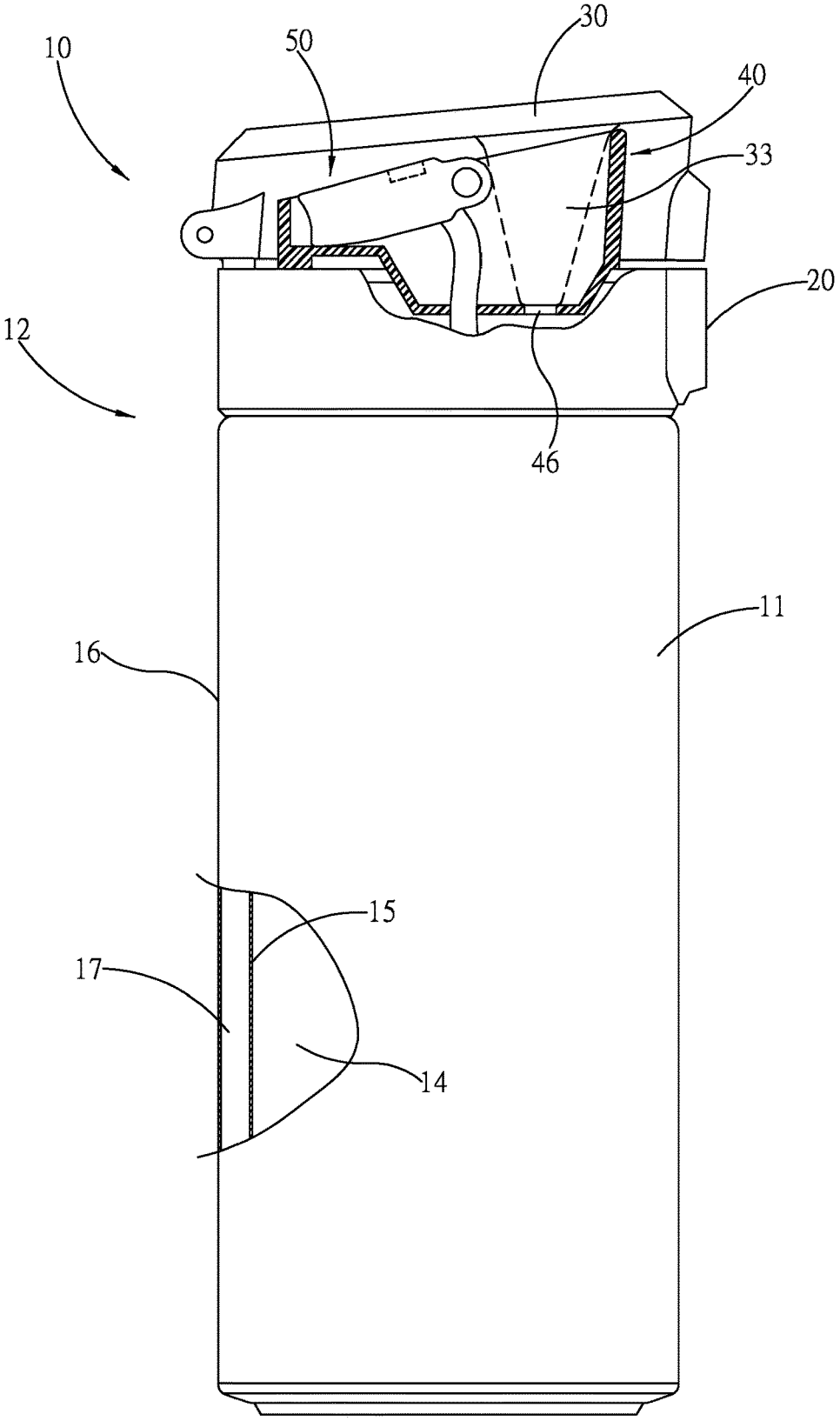
FIG. 7 is a side structural view of the assembled present invention.

Referring to FIG. 7, when the sealing member 33 of the flip cover 30 of the present invention covers and seals the connecting ring 20, the surface of the sealing member 33 presses on the dispense opening 46 of the fill end closure 40 to achieve sealing thereof, thus preventing atmospheric pressure from easily entering the bottle main body 11 through the single sucking device 50. Hence, when carrying the water bottle structure 10, the interior drinking liquid will not easily leak out.

The bottle main body 11 has a heat preservation function provided by a structure comprising an inner cylinder 15 and an outer cylinder 16 with a thermal insulated space 17 formed therebetween. The interior of the inner cylinder 15 is the containment space 14, which upwardly affords passage to the dispense opening 46 of the fill end closure 40 and the sucking device 50. The structure uses the thermal insulated space 17 to enable the containment space 14 of the bottle main body 11 to achieve heat preservation effectiveness.

Figure 8:
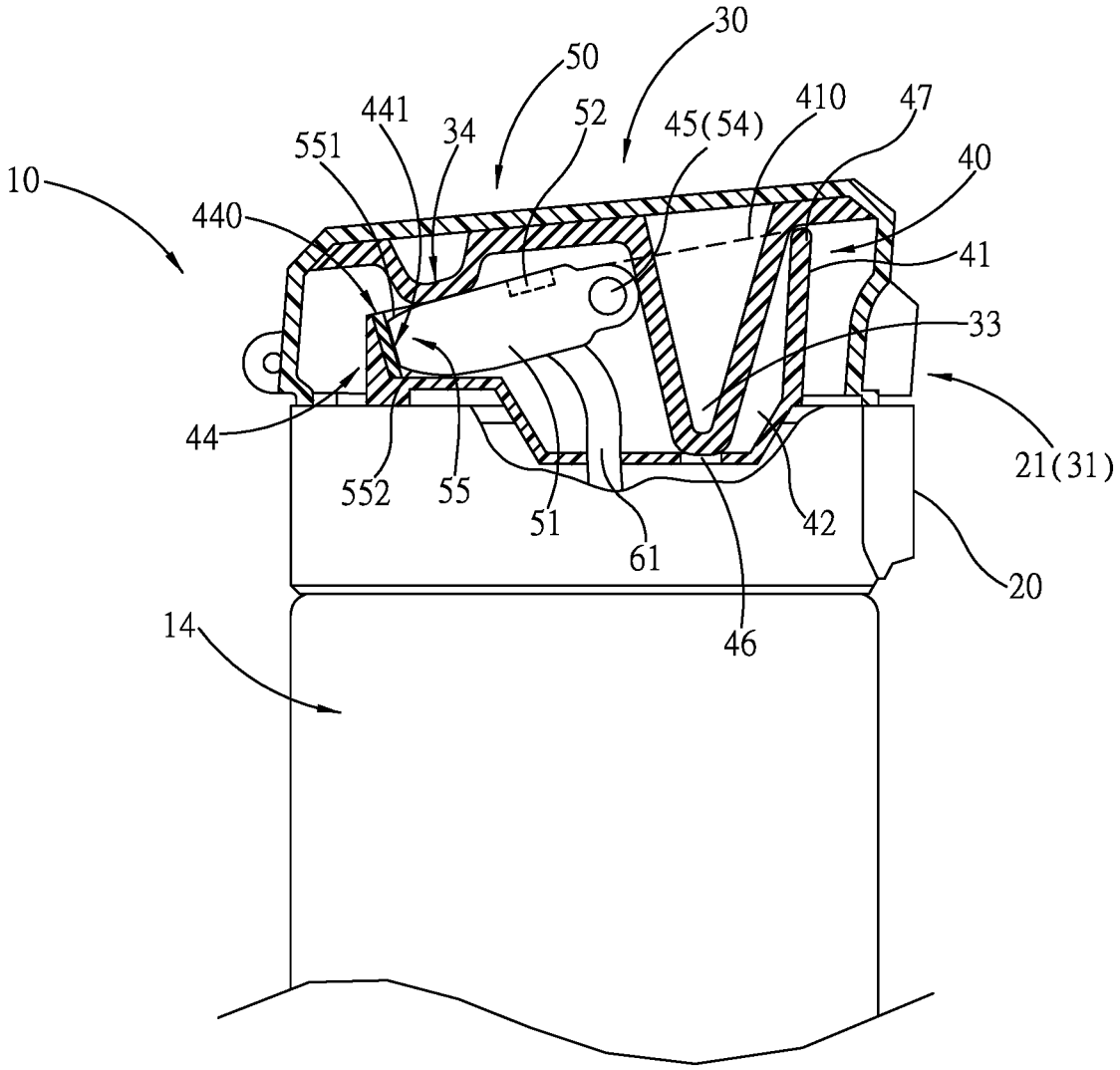
FIG. 8 is a cross-sectional view depicting the state after pressing on a flip cover according to the present invention.

Referring to FIG. 8, regarding the drinking system of the water bottle structure 10 of the present invention, the inner bottom surface of the fill end closure 40 is provided with the dispense opening 46 that affords passage to the containment space 14 and enables dispensing drinking liquid from the mouth opening 47. During this process, atmospheric pressure must be channeled into the inner space of the containment space 14 in order to allow repeated outward dispensing of the interior drinking liquid from the dispense opening 46. The channeling-in method of the present invention to equalize atmospheric pressure is depicted in FIG. 5, wherein channeling-in of atmospheric pressure is guided from the sucking outlet 55 configured on the sucking mouth piece 51 of the sucking device 50 into the interior of the containment space 14 through the flexible section 61. Comparing with another actualization, wherein drinking liquid is sucked through the sucking device 50 with the external atmospheric pressure entering the containment space 14 from the dispense opening 46 by negative pressure produced at the sucking outlet 55 by sucking thereon to achieve equalization, thus allowing interior drinking liquid to dispense out from the sucking outlet 55.

When carrying the water bottle structure 10, the user can use the sealing member 33 on the inner surface of the flip cover 30 to seal the dispense opening 46. In a practical application, the inner surface of the flip cover 30 corresponding to a circumferential upper collar 410 on the wall surround 41 of the fill end closure 40 effects a mutual sealing join therewith (the joining method is a general planar press fitting structural design, and thus not further detailed herein). The above-described sealing join with the upper collar 410 encloses the space of the fill cavity 42, however, when a user picks up and moves the water bottle structure 10 producing an angular positional change thereof, it is possible that drinking liquid inside the containment space 14 will pass through the flexible section 61 in a reverse direction and leak out from the sucking outlet 55, accumulating in the fill cavity 42 of the interior of the fill end closure 40. Accordingly, it is further necessary to improve the closed sealing of the inner surface of the flip cover 30 on the upper collar 410 to stop drinking liquid remaining in the inner space of the fill cavity 42 from leaking out from the assembled clearance between the flip cover 30 and the connecting ring 20. Thus, there is an additional requirement in the degree of precision during production.

The present invention further actualizes pre-positioned sealing of the dispense opening 46 and the sucking outlet 55 to close up any leaking of drinking liquid contained in the water bottle, wherein, during the process of covering and sealing with the flip cover 30, the dispense opening 46 and the sucking outlet 55 of the sucking device 50 are both concurrently sealed. The interior of the flip cover 30 in the present embodiment is provided with the sealing member 33 corresponding to the dispense opening 46, and a pressing portion 34 is provided corresponding to the upper surface of the sucking mouth piece 51 in a stored away state. The receiving cavity 44 is provided with a press fit surface 441 corresponding to one side of the stored away sucking outlet 55 that enables effecting an interfacial fit at the end opening of the sucking outlet 55. The press fit surface 441 is an inclined surface that corresponds to the end surface of the sucking outlet 55, and the pivot function of the base portion 54 enables swinging the sucking outlet 55 toward the press fit surface 441 to form the interfacial fit of corresponding surfaces. Accordingly, the end opening of the sucking outlet 55 is subjected to an oblique wedging pressure when in a stored away state.

The above-described joining state of surfaces is subjected to pressing by the pressing portion 34, and uses the connective application of force by the flip cover 30 on the pressing portion 34 to downwardly press the sucking mouth piece 51. The sucking outlet 55 of the sucking mouth piece 51 then press fits the press fit surface 441 of the receiving cavity 44, and uses the press fit surface 441 to effect an oblique end surface sealing engagement on the sucking outlet 55, at which time the sealing effectiveness is identical to the concept depicted in FIG. 5, and derives from the cover sealing of the flip cover 30 when carrying the water bottle structure 10. Hence, any drinking liquid that discharges from the flexible section 61 is blocked by a sealing effect formed by the interfacial fit between the press fit surface 441 and the sucking outlet 55. Based on this design, after sucking contained drinking liquid through the mouth using the sucking mouth piece 51, any residual saliva will not be washed by liquid drops seeping out; moreover, a backflow of remnant liquid drops in the interior of the fill cavity 42 is prevented that would otherwise contaminate the drinking liquid inside the containment space 14 when opening the sealing member 33.

When a user opens up the flip cover 30 and uses the mouth opening 47 to drink contained drinking liquid from the dispense opening 46 using their mouth, because the flip cover 30 concurrently releases the pressing portion 34, thus, the pressing force acting on the sucking outlet 55 is cut off, which disengages the sucking outlet 55 and causes a clearance to form with the press fit surface 441 that enables atmospheric pressure to enter therethrough. The clearance thus realizes a connection passage to the ambient atmospheric pressure that enables the sucking outlet 55 to reversibly allow the atmospheric pressure to enter the containment space 14 through the flexible section 61, thereby equalizing the internal pressure and allowing the contained drinking liquid to dispense out from the dispense opening 46.

A more explicit operating method involving the formation of the clearance between the above-described sucking outlet 55 and the press fit surface 441 uses the structural forces among the upper components of the water bottle structure 10 to actualize an elastic flipping open action whereby the flexed counteracting elastic force of the flexible section 61 propels and springs open the sucking mouth piece 51 that is used to cause the sucking outlet 55 to flip open and separate from the press fit surface 441 from its original downward swiveled position. This elastic flipping open mechanism can also be configured at the assembled movable pivot portion 45 of the base portion 54 using an elastic member such as a V-shaped axial tension spring piece (not shown in the drawings) to form a directional elastic force. Such an elastic applied force in a clockwise direction will produce a slight angular flicking open motive force that causes the sucking outlet 55 to disengage from the press fit surface 441 and form a clearance.

The planar angular position of the above-described sucking outlet 55 is oblique corresponding to the press fit surface 441, wherein the distance of an upper angled end 551 of the sucking outlet 55 from the movable pivot portion 45 is greater than the distance of a lower angled end 552 of the sucking outlet 55 from the movable pivot portion 45. Accordingly, the flat surface of the end opening of the sucking outlet 55 assumes an oblique angle, and the press fit surface 441 is a flat surface corresponding thereto. When the sucking mouth piece 51 is pressed by the pressing portion 34 to the lowermost position, the inclined surface of the press fit surface 441 enables the end surface of the sucking outlet 55 to form a planar press fitting therewith.

An elastic pressing member 440 is further located in the receiving cavity 44 corresponding to the end opening of the sucking outlet 55 in a pre-positioned sealed configuration, wherein the elastic pressing member 440 serves as an elastic body corresponding to the side surface of the sucking outlet 55 and displaces the press fit surface 441. Elastic deformation of the elastic pressing member 440 is used to form an airtight seal of the sucking outlet 55. Similarly, after opening up the flip cover 30, the sucking outlet 55 flips apart from the press fit surface 441, causing an air circulation clearance to form between the end surface of the sucking outlet 55 and the press fit surface 441. In addition, when using the sucking device 50 to suck contained drinking liquid, cocking open the cocking wings 52 causes the sucking mouth piece 51 to stand up, thereby exposing the sucking outlet 55 to allow sucking of drinking liquid therethrough, with atmospheric pressure reversibly entering the containment space 14 from the dispense opening 46 to effect equalization.

The interior of the flip cover 30 in the embodiment of the present invention is provided with the sealing member 33 and the pressing portion 34, which effect a pressing action on the dispense opening 46 and the sucking mouth piece 51, respectively, hence, an angular position change of the water bottle structure 10 (when carrying) prevents drinking liquid inside the containment space 14 from seeping out from the dispense opening 46 or the sucking outlet 55, and air outside the water bottle structure 10 is also unable to enter the containment space 14, thus achieving the effect to ensure cleanliness thereof.

The sealing member 33 and the pressing portion 34 can be formed as an integral body, as long as the sealing member 33 corresponds to the dispense opening 46, and the pressing portion 34 corresponds to a pressing end portion of the upper surface of the sucking mouth piece 51 and is provided with an elastic deformation force. Hence, the fastening clearance must not be high when the clasp portion 31 fastens onto the snap fastener 21. The sealing member 33 and the pressing portion 34 can be elastic rubber pieces, such as rubber pieces that have undergone heat vulcanization. The elastic pressing member 440 can similarly be an elastic strip member, or use a fabricated rubber product.

In another realization, the elastic applied force of the elastic pressing member 440 has an interfacial effect on the sucking outlet 55, and because the sucking outlet 55 press fits the press fit surface 441 at an oblique angle, an oblique component force is produced with the base portion 54 as a pivot, and the component force exerts an elastic force on the sucking outlet 55 toward the twelve o'clock direction. The component force is stored after the pressing portion 34 press fits the sucking mouth piece 51 that reverse produces a reserve force in the elastic pressing member 440. After the flip cover 30 together with the pressing portion 34 are opened, the reserve force pushes on the sucking mouth piece 51, which causes the sucking outlet 55 to separate from the press fit surface 441 and produces an air circulation clearance. Hence, opening up the flip cover 30 by means of a single operation completes the dynamic requirements for drinking with the mouth.

The present invention uses a fill end closure, wherein front and rear portions of an upper portion thereof are respectively provided with a dispensing cavity and a receiving cavity. The receiving cavity enables storing away and flipping open a sucking device, while the dispensing cavity is provided with a mouth opening, which is paired with a dispense opening to enable drinking with the mouth or carry out a dispensing operation of contained drinking liquid. Cocking open a sucking mouth piece enables drinking contained drinking liquid by sucking. Hence, the present invention provides a versatile water bottle structure design, thus, the inventor earnestly requests the patent examiner to examine in detail this patent application and approve at the earliest convenience.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A multifunctional dispensing water bottle, which is a versatile water bottle that provides for sucking, drinking with the mouth, and dispensing a drinking liquid contained therein, comprising:

a bottle main body, an interior of the bottle main body being provided with a containment space, and an upper end affording passage to an inside and outside through an upper end opening;

a fill end closure, an upper portion of the fill end closure being structured with a fill cavity by means of a wall surround, the fill cavity is partitioned into a dispensing cavity and a receiving cavity, a bottom surface of the dispensing cavity is downwardly perforated with a dispense opening, the dispense opening upwardly affords passage to a mouth opening, and a lower plate of the fill end closure forms a water tight join with the upper end opening;

a sucking device that is movably assembled to the fill cavity, the sucking device is provided with a hollow sucking mouth piece, one end of the hollow sucking mouth piece being a sucking outlet and an other end being a base portion, the sucking outlet affords passage to a guide interface at a bottom end of the base portion, the base portion is movably assembled to the wall surround, thereby enabling the sucking mouth piece to swivel up and swivel down into the receiving cavity;

a penetrating tube, an upper end of the penetrating tube being a flexible section, the flexible section being connected to a guide interface, and a body portion of the penetrating tube penetrates a bottom surface of the fill cavity to penetrate into the containment space;

a flip cover, the flip cover covers a space of the fill end closure.

2. The multifunctional dispensing water bottle according to claim 1, wherein two sides of a longitudinal middle of the fill cavity is transversely configured with a movable pivot portion, the wherein the movable pivot portion enables connecting the base portion of the sucking device thereto, front and rear portions of the fill cavity are respectively provided with the dispensing cavity and the receiving cavity partitioned by the movable pivot portion, and space within the receiving cavity enables the sucking device to be inserted therein.

3. The multifunctional dispensing water bottle according to claim 1, wherein the sucking mouth piece is configured with cocking wings that protrude out into the receiving cavity, such that using an external force to cock the cocking wings causing connective pivoting of the sucking mouth piece.

4. The multifunctional dispensing water bottle according to claim 1, wherein the lower plate of the fill end closure is water tight assembled to an overlap collar configured on a connecting ring, a lower end of the connecting ring is joined to a connecting end of the bottle main body, and forms a water tight assembly with the upper end opening.

5. The multifunctional dispensing water bottle according to claim 1, wherein an inner surface of the flip cover is fitted with a sealing member corresponding to the position of the dispense opening provided in the dispensing cavity; an outer surface of the sealing member seals the dispense opening.

6. The multifunctional dispensing water bottle according to claim 1, wherein the receiving cavity of the fill end closure is configured with a press fit surface that enables the sucking outlet to press fit close thereon when the sucking mouth piece is stored away.

7. The multifunctional dispensing water bottle according to claim 6, wherein the press fit surface is formed from an elastic pressing member joined to a corresponding inner side of the receiving cavity.

8. The multifunctional dispensing water bottle according to claim 7, wherein the elastic pressing member produces an upward component force towards the sucking outlet.

9. The multifunctional dispensing water bottle according to claim 1, wherein an inner surface of the flip cover is fitted with a pressing portion corresponding to an upper back surface of the sucking mouth piece when the sucking device is in a stored away state; when the flip cover is closed, the pressing portion presses the sucking mouth piece, thereby causing the sucking outlet to press fit close to the press fit surface of the receiving cavity.

10. The multifunctional dispensing water bottle according to claim 1, wherein the sucking outlet is an oblique end surface, the distance of an upper angled end thereof from the base portion is greater than the distance of a lower angled end thereof from the base portion.

11. The multifunctional dispensing water bottle according to claim 1, wherein the bottle main body is configured from an inner cylinder and an outer cylinder, with a thermal insulated space formed therebetween, and an upper end of the inner cylinder connects with the upper end opening.

12. The multifunctional dispensing water bottle according to claim 1, wherein the flip cover is provided with a thermal insulation effect, an interspace formed by an inner surface of the flip cover covering the fill end closure is a thermal insulated space.

* * * * *